US005211086A

United States Patent [19]

Shu

[11] Patent Number: 5,211,086

[45] Date of Patent: May 18, 1993

[54] TOOL WITH SLIDING SLEEVE FOR RATCHET DIRECTION CONTROL

[76] Inventor: Zu S. Shu, No.11 Lane 11-1, Kuo Chung Rd., Ta Yuan Village, Ta Li Hsiang, Taichung Hsien, Taiwan

[21] Appl. No.: 909,665

[22] Filed: Jul. 7, 1992

[51] Int. Cl.[5] ..... B25B 13/46

[52] U.S. Cl. ..... 81/58.1; 81/58.3; 81/58.4

[58] Field of Search ..... 81/58, 58.1, 58.3, 58.4, 81/60, 63.1, 63.2

[56] References Cited

U.S. PATENT DOCUMENTS

| | | | |
|---|---|---|---|
| 1,563,178 | 11/1925 | Fegley et al. . | |
| 4,474,089 | 10/1984 | Scott | 81/58.1 X |
| 4,502,365 | 3/1985 | Hacker | 81/177.85 X |
| 4,768,405 | 9/1988 | Nickipuck | 81/177.85 |

*Primary Examiner*—D. S. Meislin

*Attorney, Agent, or Firm*—Leydig, Voit & Mayer

[57] ABSTRACT

A ratchet tool including a sleeve coupled to a handle, a shaft having one end engaged in the sleeve, a knob extended outwards of the sleeve and being movable, and a sleeve having an annular groove engaged with the knob, whereby the knob is shifted when the sleeve is moved.

2 Claims, 2 Drawing Sheets

TOOL WITH SLIDING SLEEVE FOR RATCHET DIRECTION CONTROL

BACKGROUND OF THE INVENTION

1. Field of the Invention

The present invention relates to a ratchet tool, and more particularly to a ratchet tool having an actuating means.

2. Description of the Prior Art

A typical ratchet tool is disclosed in U.S. Pat. No. 1,563,178 to Fegley et al, filed Apr. 3, 1923, in which, a projection 14 on a shifter 12 is pushed generally by the thumb of a user in order to change the rotational directions of the spindle 5. The projection 14 can not be easily pushed and the thumb of the user may be hurt and the user may feel pain after pushing the projection 14 several times.

The present invention mitigates and/or obviate the afore-described disadvantages of the conventional ratchet tools.

SUMMARY OF THE INVENTION

The primary objective of the present invention is to provide a ratchet tool having an actuating means for switching the active directions of the ratchet tool. In accordance with one aspect of the invention, there is provided a ratchet tool comprising a handle, a sleeve coupled to the handle, a shaft having one end engaged in the sleeve, a knob extended outwards of the sleeve and being movable, a sleeve including an engaging groove formed therein for engagement with the knob, whereby the knob is shifted when the sleeve is moved.

In accordance with another aspect of the invention, the shaft includes a plurality of teeth formed longitudinally thereon, the sleeve includes a ring element formed on one end thereof and having a plurality of teeth formed therein for engagement with the teeth of the shaft, whereby the shaft is rotated when the sleeve is rotated.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
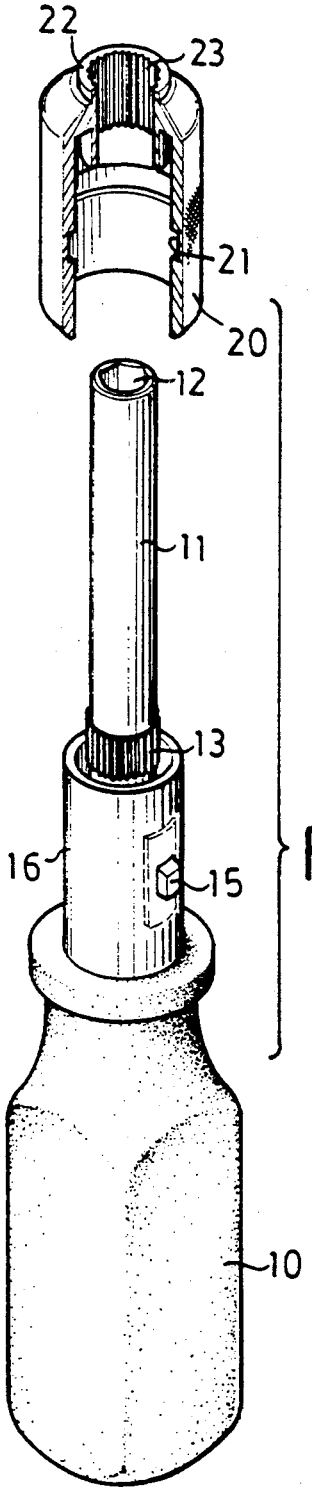
FIG. 1 is an exploded view of a ratchet tool in accordance with the present invention.
Figure 2:
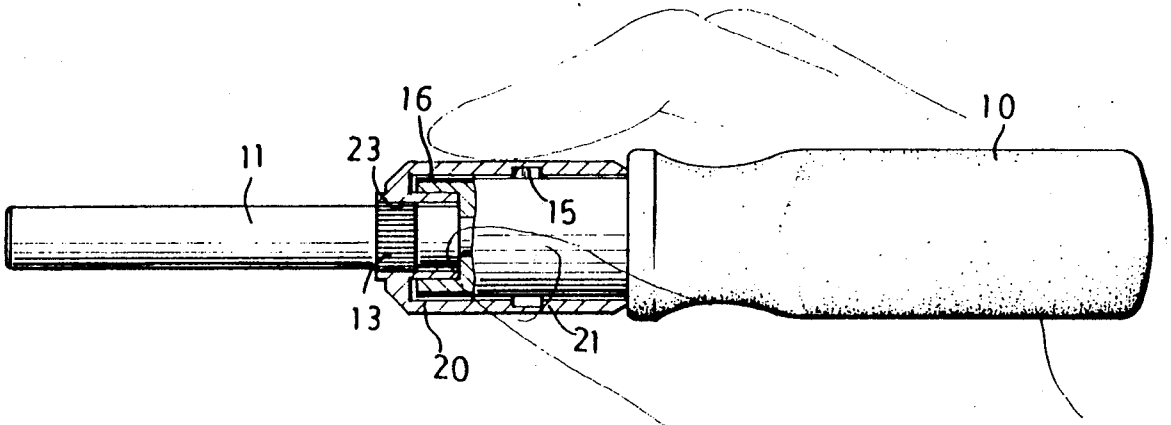
FIGS. 2 and 3 are partial cross sectional views of the ratchet tool illustrating the operations thereof.

Referring to the drawings, and initially to FIGS. 1 and 2, a ratchet tool in accordance with the present invention comprises generally a barrel 16 engaged on a handle 10 and having a shaft 11 engaged thereon opposite to the handle 10. The shaft 11 includes an engaging recess 12 in the free end thereof for engaging a bolt and the like for driving operations, the barrel 16 includes a ratchet mechanism (not shown) disposed therein similar to conventional ratchet tools, such as above-referenced U.S. Pat. No. 1,563,178. The ratchet mechanism is not related to the invention and will not be described in further detail.

The barrel 16 includes a knob 15 extended outwards therefrom. The knob 15 can be shifted in order to change the active direction of the ratchet tool. The shaft 11 includes a plurality of teeth 13 on the outer peripheral portion of one end thereof close to the barrel 16 and longitudinal relative to the shaft 11 itself. A sieve 20 includes an annular groove 21 in the inner peripheral portion thereof for engagement with the knob 15 of the barrel 16, and a ring element 22 coaxially formed on one end thereof including a plurality of teeth 23 longitudinally disposed therein for engagement with the teeth 13 the shaft 11 so that the shaft 11 and the sleeve 20 rotate in concert.

Figure 3:
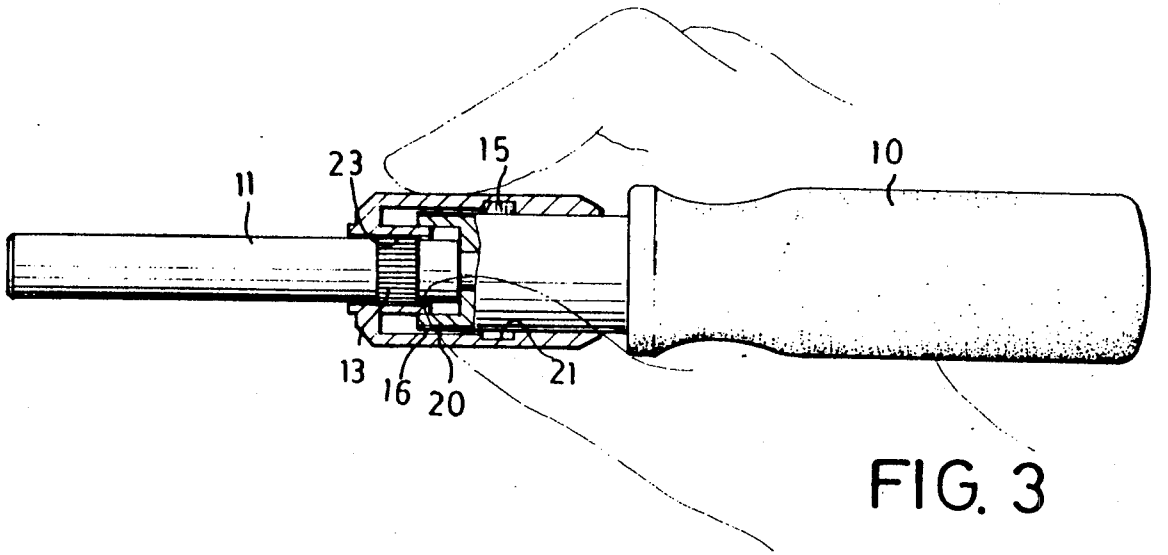

Referring next to FIGS. 2 and 3, the knob 15 can be shifted when the sleeve 20 is moved longitudinally along the barrel 16 and the shaft 11,, such that the active directions of the ratchet tool can be changed, the sleeve 20 can be easily rotated by the hand of the users; it is to be noted that, if it is inconvenient in some cases to rotate the shaft 11 by the handle 10, the shaft 11 can also be rotated with the sleeve 20 by the engagement between the teeth 13, 23 of the shaft 11 and of the sleeve 20. The teeth 13, 23 are arranged such that they are still engaged with one another whenever the sleeve 20 is moved longitudinally along the shaft 11 and the barrel 16.

Figure 4:
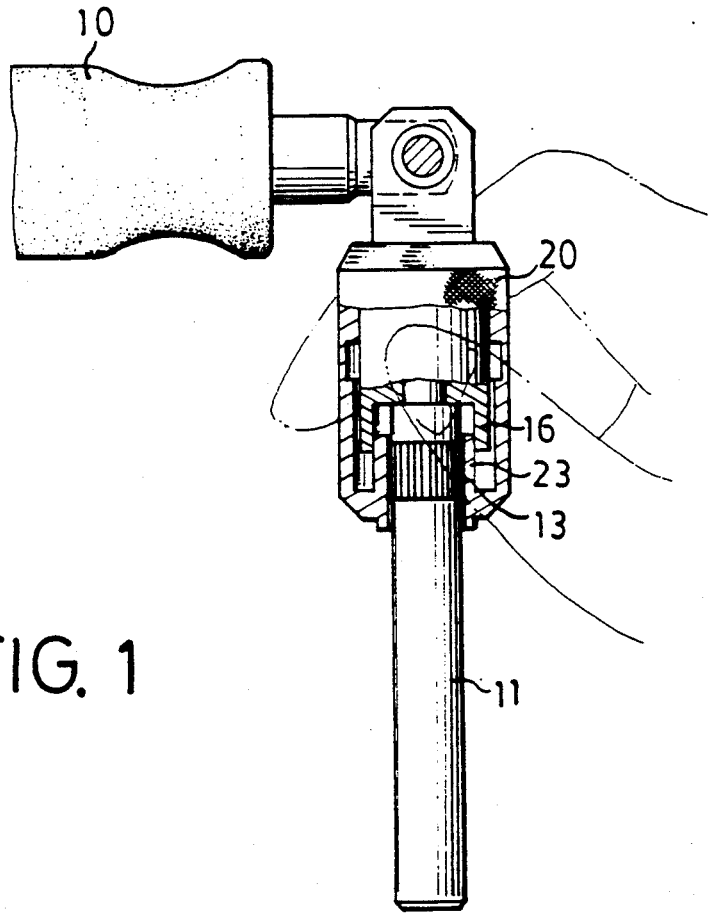
FIG. 4 is a partial cross sectional view of the actuating means which is disposed on another type of ratchet tool having a pivotally supported head portion.

Referring next to FIG. 4, the actuating means in accordance with the present invention can also be applied to a ratchet tool having a sleeve 16 pivotally coupled to the handle 10.

Accordingly, the knob 15 of the ratchet tool can be easily shifted by the actuating means of a ratchet tool in accordance with the present invention, and the thumb of the user will not be hurt by the knob 15.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool comprising a handle, an barrel coupled to said handle, a shaft including a first end engaged in said barrel, a plurality of first teeth longitudinally disposed on said shaft, and a second end including an engaging recess for engaging a bolt, a knob extending outwardly from said barrel and movable for controlling a direction of ratcheting engagement of said handle and said shaft, a sleeve slidable along said shaft and including an annular groove for engagement with said knob, a ring element on one end of said sleeve, a plurality of second teeth in said ring element for engagement with said first teeth on said shaft, whereby said shaft is rotated in concert with said sleeve, and said knob is moved when said sleeve is moved along said shaft.

2. The tool of claim 1 including a pivot coupling said barrel to said handle whereby said shaft may be disposed transverse to said handle.

* * * * *